United States Patent [19]

Right et al.

[11] 4,280,123

[45] Jul. 21, 1981

[54] MULTITONE SIGNALING DEVICE

[75] Inventors: Robert W. Right, Huntington, Conn.; Herbert W. McCord, Warren, N.J.; Vaclav O. Podany, Holyoke, Mass.

[73] Assignee: General Signal Corporation, Stamford, Conn.

[21] Appl. No.: 146,913

[22] Filed: May 5, 1980

[51] Int. Cl.[3] ..... G08B 3/00

[52] U.S. Cl. ..... 340/384 E; 340/384 R

[58] Field of Search ..... 340/384 R, 384 E; 84/1.01

[56] References Cited

U.S. PATENT DOCUMENTS 4,090,349 5/1978 Takase ..... 340/384 X

*Primary Examiner*—Harold I. Pitts

*Attorney, Agent, or Firm*—Milton E. Kleinman; George W. Killian

[57] ABSTRACT

A compact and economical circuit for a multitone horn employing a microcomputer. The system also includes an audio amplifier, a speaker, a power supply, and start control means. The start control means includes a common lead and a plurality of star leads. Connecting the common lead to a predetermined one of the start leads will initiate a predetermined one of the plurality of available tones. A selected one of the start leads may have priority to terminate any pre-existing signal and initiate an alternate signal. At least one of the start leads, including the priority start lead, may be coupled to programming means whereby the signal activated may be preprogrammed to be any selected one of the plurality of available signals. The power supply includes a pulse generator for resetting the microcomputer in response to initial application of power. The available tones include both percussive and non-percussive tones and the total number of available tones may be greater than the number of start leads.

24 Claims, 2 Drawing Figures

MULTITONE SIGNALING DEVICE

BACKGROUND OF THE INVENTION

Electrically controlled audible devices are so ubiquitous that the casual hearer seldom considers the wide range and quality of sounds that are produced by the various devices. Audible devices may include common doorbells, chimes, fire alarms, police or fire sirens, and many other varieties which will occur to one who listens with discrimination. In order to be able to describe the various types of sounds that are produced, an attempt has been made, within the industry, to assign names to the various sounds. These names have included: fast whoop; slow whoop; wail; horn; hi-lo; chimes; yeow; ding-dong; bell; warble; yelp; beep; and stutter. Other and/or alternate names have also been employed. At least on a local basis, certain types of audible sounds have become associated with certain emergency conditions or activities. For example, although there may not be an entirely universal sound for police sirens, it is conventional for all police vehicles, in any given locality, to employ an identical sound. By convention, anyone else needing an alarm sound would employ a different tone. Thus, the fire fighting vehicles, ambulances, and air raid warning signals would all have a different characteristic making it easy for the hearer to identify the meaning of the sound. Within large buildings such as offices, factories, department stores, hospitals, schools, etc., it is often desirable to be able to produce different tones indicative of selected conditions. For example, it might be desirable to use audible devices to indicate such conditions as: start time; end time; change time; lunch time; stand by for voice message; evacuate the building; fire alarm; dangerous condition; or any number of other conditions which it may be desirable to signal by audio device according to the needs and operation of the facility.

In those situations wherein it is desirable to be able to selectively produce one of a plurality of different audio signals, it is convenient and economical to be able to produce the full range of audio signals with a single device thereby eliminating the need for multiple devices and control systems. Systems with these features and characteristics are not broadly new and are believed to be too familiar to require further elaboration.

The present invention relates to a convenient, compact, and economical device which is capable of selectively producing any one of a plurality of distinguishable, audible signals. U.S. Pat. No. 4,065,767 issued Dec. 27, 1977 to Jacob Neuhof et al. and assigned to the same assignee as the present invention discloses a programmable electronic siren and the means for controlling it. While the present invention may have some features and characteristics in common with the cited patent, it will be shown that the structure of the present invention includes numerous features and characteristics combined with convenience and economy which are not available in the prior art. Other devices having some features or characteristics in common with the present invention are disclosed in the following patents:

U.S. Pat. No. 3,137,846 issued June 16, 1964 to H. G. Keeling and entitled Electronic Siren;

U.S. Pat. No. 3,882,275 issued May 6, 1975 to G. S. Carroll and entitled Sound Communication System;

U.S. Pat. No. 3,889,256 issued June 10, 1975 to R. F. Sieslak et al and entitled Automatic Control for Audible Electronic Warning System;

U.S. Pat. No. 3,905,016 issued Sept. 9, 1975 to C. J. Peterson and entitled Reverse Signal Alarm System;

U.S. Pat. No. 3,981,007 issued Sept. 14, 1976 to R. F. Sieslak et al and entitled Industrial Control for Audible Electronic Warning System; and U.S. Pat. No. 4,016,496 issued Apr. 5, 1977 to P. Eastcott and entitled Method and Apparatus for Producing Ramp Signals with Rounded Inflection Points.

SUMMARY OF THE INVENTION

The present invention comprises a stand alone multiple tone audible signaling device capable of selectively producing one of a plurality of distinguishable signals, amplifying the signal, and producing an audible sound through a speaker. While the unit may have wide utility, it is anticipated that it will find primary application in industrial locations where high audible output and solid state reliability are advantageous. The unit operates from a local power supply and is capable of producing a plurality of unique and readily distinguishable audio signals. Obviously the number of signals that may be produced is a matter of design choice, but the commercial application of this invention is capable of producing 13 different audible signals. Some models may be able to produce all 13 signals while others may produce a lesser number at least some of which may be selectively controlled to be any one of the plurality of available signals. The system includes a power supply, a speaker, an audio amplifier, a microcomputer, and a control circuit.

From the foregoing, it will be seen that it is a principal object of the invention to provide a stand alone audible signaling device with multiple tone generating capability.

It is a more specific object of the invention to provide an audible signaling device with multiple tone generating capability wherein the tone generated may be selectively controlled. It is another object of the invention to provide an audible signaling device of the type described which employs a microcomputer for the production of electronic signals, which when amplified, produce the desired audible signals.

It is another object of the invention to exercise control over the microcomputer so that signals indicative of the desired output audible signal will be reproduced in response to selected input signals.

It is another object of the invention to provide a start control means wherein a signal indicating that a predetermined audible tone should be produced will take priority and terminate any signal being produced and originate the priority signal.

It is another object of the invention to provide start control means for permitting an input signal on a predetermined signal lead to initiate the sounding of any one of the plurality of available audible signals.

It is another object of the invention to be able to produce both percussive and non-percussive signals.

It is yet another object of the invention to initiate a reset pulse to the microcomputer in response to the initial application of power to the system.

It is another object of the invention to be able to respond differently to output signals from the microcomputer indicative of percussive tones at repetition rates varying by at least an order of magnitude.

It is yet another object of the invention to include output signal control means for distinguishing between output signals from the microcomputer indicative of percussive and non-percussive tones.

Other features, objects, and advantages of the invention will readily become apparent as the following description proceeds.

BRIEF DESCRIPTION OF THE DRAWING

The drawing comprises two figures which, when arranged side by side comprises a circuit diagram of the system. The circuit diagram employs conventional symbols for the various components. However, in order to further facilitate perusal and understanding of the invention, a system of designation has been employed which will aid in identifying both the character and location of the element. More specifically, when the element constitutes an electrical device, the first character of the designation will comprise a letter indicative of the nature of the device. For example, when the first letter of the designation is C, D, or R, the designated element is a capacitor, diode, or resistor, respectively. When the first letter is a T or Z, the element is a transistor, or a Zener diode, respectively. Identifiers without an initial alpha character indicate other elements such as: terminals, junctions, individual wires, or other devices. The second character of elements starting with an alpha character will give some indication of the location of the element. More specifically, when the second letter is C or M, the elements relate to a common circuit or a microcomputer, respectively. When the second character of the identifier is 1, 2, 3, or 4, the elements relate to the first, second, third, or fourth, respectively, start circuits of the start control means. When the second character of identifiers starting with an alpha character is a 5, the elements are elements in the output signal control circuit. When the numeral following an initial letter is 6, the elements are part of the regulated power supply and initial power-on reset pulse generator.

DESCRIPTION OF THE PREFERRED EMBODIMENT

Figure 1A:
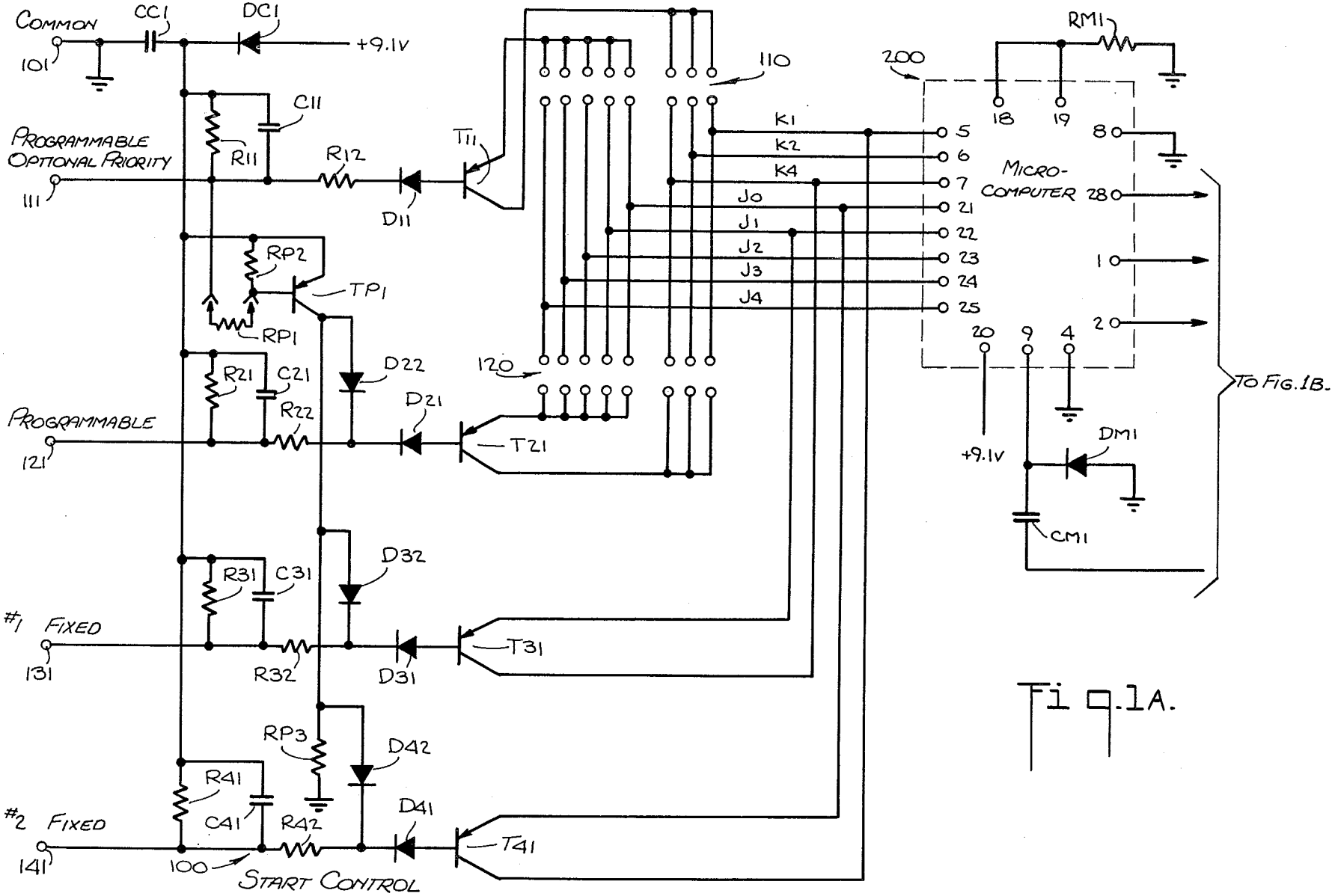
FIG. 1A includes the start control circuit and the microcomputer.
Figure 1B:
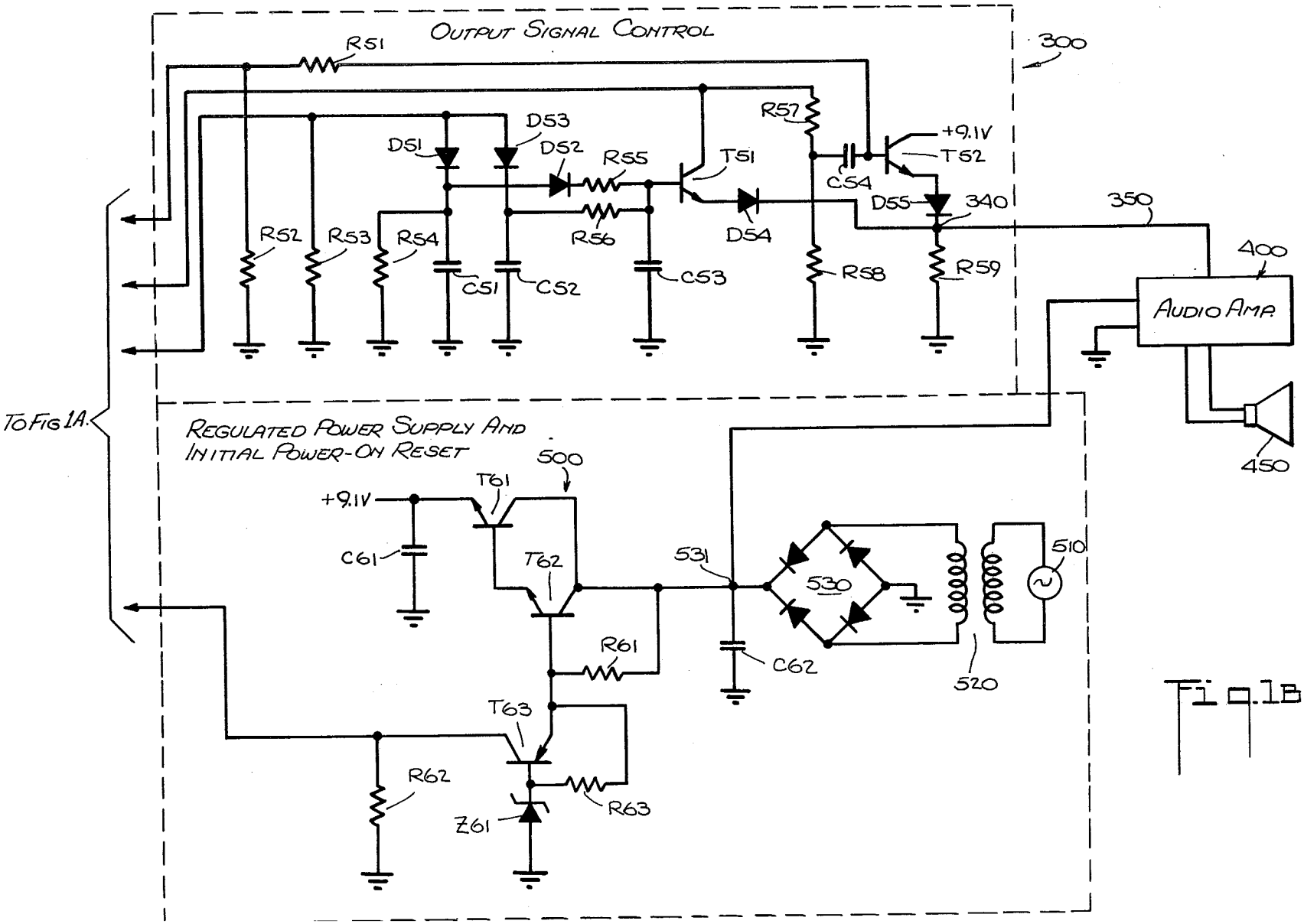
FIG. 1B includes the output signal control circuit, the regulated power supply and initial power-on pulse generator, the audio amplifier, and the speaker.

The multi-tone signaling device of the present invention comprises a start control circuit 100 which provides input and control signals to a microcomputer 200. Output leads of the microcomputer 200 are fed to the output signal control circuit 300 and the output of this circuit is an input to an audio amplifier 400 which drives speaker 450. A regulated power supply 500 provides DC power to the system and also provides an initial reset pulse to the microcomputer 200 when the regulated power supply is originally turned on. The regulated power supply provides a DC potential having a positive potential with a nominal value of 9.1 V and a negative potential with respect to the 9.1 volts which is indicated by the conventional ground symbol. It should be understood that all points designated 9.1 V are coupled together and that all points designated as connected to ground are coupled together.

Although a single audio amplifier 400 and speaker 450 are shown, it should be understood that an audio amplifier 400 could drive a plurality of speakers 450 and furthermore, the output signal control circuit 300 could drive a plurality of audio amplifiers. Accordingly, although the system illustrated in the drawing employs a single speaker, it will be readily understood that if a plurality of speakers 450 are required, such speakers may be used with one or more audio amplifiers 400 as may be required and all speakers 450 will sound in synchronism under control of the system as described herein below.

Considering first the regulated power supply and initial power-on reset pulse generator, there will be seen an AC power supply 510 which is coupled to a transformer 520 feeding a diode bridge 530. As may be seen, one terminal of the output of the diode bridge 530 is coupled to ground and the other terminal 531 is coupled to the audio amplifier 400 and to the remainder of the power supply 500. When the power is first turned on, the potential at terminal 531 will rise from a zero value. As the potential at terminal 531 rises, transistors T61 and T62 are turned on and the power supply terminal designated +9.1 V rises from 0 V towards 9.1 V. As the output potential of the power supply 500 rises towards the 9.1 volt value, this potential is fed to the microcomputer 200 through pin 20. This can begin to activate the microcomputer 200 and the various circuits therein may "wake-up" in any state. Accordingly, in order to set the microcomputer 200 to a predetermined state, it is necessary to provide an initial reset pulse on pin 9 of the microcomputer 200. When the system is turned off, the capacitor CM1 associated with the microcomputer 200 is discharged from ground on one side of the diode DM1 through the capacitor CM1 to ground at resistor R62. As the potential at terminal 531 rises towards the zener value of zener diode Z61, the transistor T63 will suddenly conduct and charge capacitor CM1 thereby providing a pulse at pin 9 of the microcomputer 200. The zener diode Z61 clamps the base of transistor T63 to a regulated value and thereby regulates the value of the output potential designated +9.1 v. Depending upon the characteristics of the various components, the output potential may vary somewhat from 9.1 volts.

The reset pulse provided through capacitor CM1 to pin 9 of the microcomputer 200 resets the microcomputer 200, and all the circuits therein, so that they are in a known and predetermined state ready to receive control signals and produce output signals. The diode DM1 prevents the application of a negative potential to pin 9 of the microcomputer 200 when the power 510 is turned off and there is no longer a potential at the lower terminal of the capacitor CM1.

The microcomputer 200 comprises the Texas Instrument TMS 1000 NLL Series 4-bit microcomputer. Further information concerning its input control terminals and output signals on the output terminals will be given herein below.

Multiple Tone Signals Available

The multiple-tone signaling device is capable of producing a plurality of distinct and identifiable signals. In the system shown in the drawing, 13 separate audible signals may be produced. However, it will be apparent that systems with a greater or lesser number N, of unique and distinctly different audible output signals could be produced. It is difficult to describe audible signals with words. However, names for certain types of audible signals have been used in the art and the signaling device of this invention is designed to produce audible signals usually and customarily referred to as: slow whoop; fast whoop: hi-lo; chime; yeow; ding-dong; bell; warble; siren; beep; stutter; fast siren; and horn. Of these audible signals, the chime, ding-dong, and bell have percussive sounds. The start control circuit 100, by selectively coupling together one lead from a group of three, to another lead from a group of five input control terminals to the microcomputer, will cause the microcomputer 200 to produce an output signal which will eventually cause production of the desired tone. The group of three input leads are designated K1, K2, and K4 and are coupled to pins 5, 6, and 7, respectively, of the micro-computer 200. The group of five input leads are designated J0, J1, J2, J3, and J4, and are coupled to pins 21, 22, 23, 24, and 25 of the microcomputer 200. There follows some approximate characteristics of each audible sound together with the K and J leads which must be coupled to originate the sound:

| No. | Leads | Sound | Characteristics |
|---|---|---|---|
| 1 | K1 J4 | Slow Whoop | 600–1250 Hz upward sweep in four seconds and repeat. Duty Factor decreases 65 to 25%. |
| 2 | K2 J2 | Fast Whoop | 600–1250 Hz upward sweep in one second and repeat. Duty Factor decreases 65 to 25%. |
| 3 | K4 J0 | Hi-Lo | 780 and 600 Hz alternately, 0.52 seconds each. 50% duty factor. |
| 4 | K2 J3 | Chime | Percussive 570 Hz tone damped to 0, repeated 1 per second. |
| 5 | K3 J2 | Yeow | 1250–600 Hz downward sweep in 1.6 seconds and repeat. Duty factor 25–65% |
| 6 | K4 J3 | Ding-Dong | Percussive pairs of 700 and 750 Hz tones, each damped to 0, repeated in two seconds. |
| 7 | K1 J3 | Bell | Percussive 816 Hz tone, lightly damped, reinitiated every 20.5 ms. |
| 8 | K1 J1 | Warble | 575 and 770 Hz alternately, 87 ms each. 50% duty factor. |
| 9 | K1 J2 | Siren | 600–1250 Hz up and down sweep in 8 seconds and repeat. 65 to 25% duty factor. |
| 10 | K2 J0 | Beep | 470 Hz, 50% duty factor, 0.55 seconds on, 0.55 seconds off. |
| 11 | K2 J1 | Stutter | 470 Hz, 50% duty factor, 83 ms on, 109 ms off. |
| 12 | K4 J1 | Fast Siren | 600–1250 up and down sweep in 0.25 seconds and repeat. Duty factor 65 to 25%. |
| 13 | K1 J0 | Horn | 470 Hz continuous, 50% duty factor. |

Start Control Circuit

The start control circuit is shown generally as 100 and as illustrated provides five input leads although other numbers could be provided. There is a common input lead 100 also designated common and four other input leads designated:

(111) Programmable optional priority
(121) Programmable
(131) #1 fixed; and
(141) #2 fixed.

Coupling the common lead 101 to any one of the other four input leads will initiate sounding of any one of the plurality of N available tones. As indicated, the programmable optional priority input lead 111 and the programmable input lead 121 may be programmed to initiate sounding of any desired one of the N available sounds. Furthermore, the programmable optional priority input lead 111 may include a priority wiring which will cause termination of any audible signal already in progress and initiation of the programmed signal. The programmable input lead 111 may be programmed to initiate sounding of any desired one of the available plurality of N audible signals. The #1 fixed and #2 fixed input leads 131 and 141, respectively, are hard-wired to originate specific audible sounds. It will be apparent that additional input leads could be provided in systems which require more than four distinct different audible sounds. As already mentioned with respect to the microcomputer, each audible sound is initiated in response to coupling together one of the K leads and one of the J leads. Thus, for example, when the common lead 101 is coupled to the #2 fixed lead, it will be shown that the K1 lead of the microcomputer is coupled to the J0 lead by rendering the conduction control device comprising transistor T41 conducting. In similar manner, the K4 lead is coupled to the J1 lead when the conduction control device comprising transistor T31 is rendered conducting. Associated with the programmable optional priority input lead 111 and with the programmable input lead 121 are switches 110 and 120, respectively. As will be seen, the emitter of transistor T11 is connected to five terminals of the switch 110 and the collector of transistor T11 is connected to three terminals of the switch 110. In like manner, the emitter and collector of transistor T21 are connected to terminals of switch 120. As may be readily visualized from the pictorial representation of the switches 110 and 120, selections means are provided for coupling together any pair of vertically opposed terminals. Accordingly, by appropriate switch actuation, the emitters of transistors T11 and T21 may be coupled to any one of the five J input leads to the microcomputer 200; and the collectors of these transistors may be selectively coupled to any one of the three K input leads of the microcomputer 200. Thus, in response to rendering transistor T11 or T21 conducting, a predetermined pair of K and J leads are coupled together to initiate a predetermined audible tone.

Considering now more specifically the circuit actuation of the start control circuit 100, it will be seen that the common lead 101 is at a predetermined potential, namely ground potential, and that capacitor CC1 is charged. T11, T21, T31, and T41 are conduction control devices comprising PNP transistors and therefore will be in a state of non-conduction unless the base is negative with respect to the emitter. The base of each transistor T11, T21, T31, and T41, is held at positive potential from the 9.1 volt supply through the resistor R11, R21, R31, and R41, respectively. In response to coupling the common lead 101 to the #1 fixed input lead, for example, it will be seen that the ground, or negative potential, on the common lead 101 will be coupled to the #1 fixed lead 131 thereby providing a negative potential on the base of transistor T31. With the base of transistor T31 at a negative potential, the state of conducton of the transistor T31 will change to conducting and the J1 lead from the microcomputer 200 will be coupled from the emitter to the collector of transistor T31 to the K4 lead of the microcomputer 200. As may be seen from the table given hereinabove, this will originate the audible sound designated fast siren. It will be apparent that if the emitter and collector of transistor T31 had been hard-wired to any other pair of K and J terminals, it would have been possible to cause the application of ground to the #1 fixed input lead 131 of the start control circuit 100 to originate actuation of any other desired audible signal. In like manner, application of ground to the #2 fixed input lead 141 of the start control circuit 100 will couple together the K1 lead and J0 lead to initiate sounding of the horn signal.

Priority Signal

If it is desired to use the priority option, the resistor RP1 will be included in the circuit. For manufacturing convenience, it may be expedient to always provide the resistor RPI and include a loop of wire which is cut when it is desired to eliminate the priority option. If the circuit for the priority system is employed and the RP1 resistor is wired as shown, it will be seen that in response to the application of ground to the programmable optional priority lead 111, ground will be applied to the base of the transistor TP1. This will render that transistor conducting and the 9.1 volt power supply potential will be coupled from the emitter to collector of transistor TP1 and through diodes D22, D32, and D42, to apply the positive power supply potential to the bases of the transistors T21, T31, and T41, respectively, thereby rendering them non-conducting. Accordingly, if any one of the transistors T21, T31, or T41, had been conducting it will be turned off and any audible signal initiated in response to the conduction of these transistors will be terminated. In addition to turning on the priority transistor TP1, the ground on the programmable optional priority input lead 111 will turn on transistor T11, thereby coupling its emitter and collector and coupling together a K and J lead in accordance with the connections made in switch 110. Accordingly, application of ground to the programmable optional priority lead 111 will terminate any audible signal in progress and initiate a priority audible signal which may be any one of the plurality of available signals as controlled by the programming of the selection means comprising switch 110.

It will be apparent that when ground is removed from any one of the input leads of the start control circuit 100, the associated transistor will be turned off and the audible signal associated therewith terminated.

Microcomputer

The microcomputer 200 serves as a signal generator and comprises a MOS/LSI 1-chip microcomputer of the TMS 1000 NLL family manufactured by the Texas Instruments Corporation. It is one of a family of P-channel MOS 4-bit microcomputers with a ROM, a RAM, and an arithmatic logic unit on a single semi-conductor chip. Tone requirement specifications determined the software that is reproduced during wafer processing by a single, level mask technique that defines a fixed ROM pattern.

The microcomputer 200 has several pin connections and pertinent ones are shown in FIG. 2. As may be seen, ground is applied to pins 4 and 8 and also through a resistor RM1 to pins 18 and 19. The positive 9.1 volt DC power supply is coupled at pin 20. As already mentioned, a reset pulse is provided at pin 9 to reset the microcomputer 200 when power is initially applied. The microcomputer 200 is capable of producing 13 unique output signals, any one of which may be selected by coupling together one of the leads from pins 5, 6, and 7 to one of the leads from pins 21 through 25. Selectively programmable means for doing this has been described with respect to the start control circuit 100.

The audible signals that are to be reproduced fall into two broad catagories, namely percussive and non-percussive. The percussive sounds are the bell, chime, and ding-dong. It should be noted that the percussive rate for the bell is high as compared with the percussive rate for the chime or ding-dong. That is, as set forth in a table hereinabove, the percussive signals for the bell are initiated every 20.5 milliseconds, while those for the chime are repeated once per second, and for the ding-dong once every 2 seconds. Thus the chime and ding-dong have repetition rates at least an order of magnitude greater than that of the bell. When the microcomputer 200 senses that the output signal is to be one of the percussive tones, a ground is placed on pin 28; and conversely, when the audible signal to be reproduced is one of the non-percussive signals, the microcomputer 200 does not connect a ground to pin 28. In addition, at the start of each cycle of audible tone a pulse is placed on pin 2 and a square wave of appropriate frequency is placed on pin 1.

The manner in which the output signals on pins 1, 2, and 28 of the microcomputer 200 are caused to produce the desired audible signals at the speaker 450 will be explained more fully in connection with the output signal control circuit 300.

Output Signal Control Circuit

The output signal control circuit 300 receives power from the regulated power supply 500 and receives input signals from pins 1, 2, and 28 of the microcomputer 200 which has signals thereon as explained with respect to the microcomputer 200. The output signal control circuit 300 operates on the signals received from the microcomputer 200 and produces an output signal on lead 350 to the audio amplifier 400 which, in turn, activates the speaker 450.

It will be observed that the conduction control device comprising transitor T52 is of the NPN type and that therefore, when the microcomputer 200 places a ground on pin 28 indicating that the output signal is a percussive signal, the ground on pin 28 will be applied through resistor R51 to hold transistor T52 turned off. Conversely, when the microcomputer 200 produces a signal indicative of non-percussive tones, pin 28 goes to a high level and the transistor T52 will be allowed to be turned on.

Time Constant Circuits

As mentioned hereinabove, the microcomputer 200 places a pulse on pin 2 at the start of each cycle of the audible signal. It will be seen that the pulse on pin 2 can pass through diodes D51 and D53 to charge capacitor C51 and C52, respectively. Capacitor C52 and resistor R56 comprise a first time constant circuit and capacitor C52 and resistor R55 comprise a second time constant circuit. Because of the relative values of these capacitors and resistors, the time constant circuit of capacitor C52 and resistor R56 provide a long time constant as compared with the time constant of the circuit comprising capacitor C51 and resistor R55. That is the product of R56 and C52 is greater than the product of C51 and R55. The function of these time constant circuits will be explained more fully herein below.

Percussive Tones

As already mentioned, the system produces three audible percussive tones designated bell, ding-dong, and chime. The repetition rate of the bell is 20.5 milliseconds while the repetition rate of the chime and ding-dong are 1 and 2 seconds, respectively. It will be seen that the long time constant circuit comprising C52 and R56 will be used in connection with the ding-dong and chime and that the short time constant circuit comprising C51 and R55 will be used with the bell signal.

It is characteristic of a percussive tone that the tone decays exponentially or logarithmically. As the discussion proceeds, it will be seen that the time constant circuits are instrumental in producing the appropriate decay to simulate a percussive audible signal.

Chime and Ding-Dong Percussive Tones

When either the chime or ding-dong percussive tone is to be produced, the microcomputer 200 will place a predetermined potential such as ground on pin 28 to hold transistor T52 turned off and a pulse will be placed on pin 2 to initiate each percussive cycle. Finally, a square wave pulse of appropriate duration will be placed on pin 1. In response to the pulse on pin 2, the capacitors C51 and C52 will be charged. At the start of the pulse on pin 2, the base of transistor T51 has a high voltage placed thereon by the pulse. After the pulse has terminated, the time constant circuits described hereinabove begin to control the base potential of the transistor T51. The capacitor C51, the capacitor of the short time constant circuit, discharges rather quickly, but the capacitor C52 discharges much more slowly and controls the potential at the base of transistor T51. During this time, the diode D52 is back biased. While the capacitor C51 is discharging, the base potential of transistor T52 drops at a rapid initial rate, but when capacitor C51 is discharged and capacitor C52 is in control of the potential of the base of transistor T51, the rate of decay is reduced. It will be recalled that a square wave of an appropriate period is placed on pin 1 of the microcomputer 200 and this is applied to the collector of transistor T51 and passed to the emitter and through the diode D54 to the junction 340 between resistor R59 and diode D55. This signal is then applied on lead 350 to the audio amplifier 400. As the capacitor C52 discharges through resistor R56, the base potential of transistor T51 decays, thereby decreasing the base drive and the potential across the emitter resistor R59 decreases. The decaying voltage across resistor R59 decays at a logarithmetic rate due to the control of the time constant circuit on the base of transistor T51 and this signal is presented to the audio amplifier 400. Accordingly, the signal presented to the audio 400 is representative of a percussive tone.

The action just described will repeat for each cycle of the percussive tone which will occur at one and two second intervals for the chime and ding-dong, respectively. Obviously, the repetition rate could be different, if desired; and/or the rate of decay could be modified by a change in the time constant circuit.

Bell Percussive Tone

The bell audible tone comprises a series of percussive signals repeating approximately every 20.5 milliseconds and therefore having a pulse repetition rate more than an order of magnitude greater than that for the chime or ding-dong. The circuit functions is substantially the same manner as that described with respect to the chime and ding-dong percussive signals, except that the pulse on pin 2 to charge the capacitors of the time constant circuits is applied once every 20.5 milliseconds rather than once every one or two seconds. In this application, the time constant circuit comprising capacitor C52 and resistor R56 is relatively long, and the capacitor C52 has no significant discharge between successive pulses on pin 2 of the microcomputer 200. However, the short time constant circuit comprising capacitor C51 and resistor R55 is able to decay significantly between successive pulses on pin 2, and thereby this time constant circuit exercises control on the base of transistor T51. The base potential of transistor T51 cannot go as low with the bell tone as it did with the chime and ding-dong because capacitor C52 remains substantially fully charged. However, the base of transistor T51 does start to decline logarithmatically as capacitor C51 discharges and this produces a decaying signal at point 340 and this decaying signal simulates a bell sound.

Non-Percussive Signals

For non-percussive signals, no ground is applied to pin 28 of the microcomputer 200 and therefore, the transistor T52 is not held turned off. As before, at the start of each cycle, a pulse is placed on pin 2 thereby charging the capacitors C51 and C52 as heretofor described with respect to percussive signals. However, as will be seen, with transistor T52 conducting, the diode D54 isolates any signal passing through transistor T51 and therefore, such signals are not applied at point 340 and do not effect the audio amplifier.

With pin 28 at 9.1 volts, the transistor T52 is turned on and the square wave signal at pin 1 is divided across resistors R57 and R58 serving as voltage dividers, and the signal at the junction point provides base current to the transistor T52. Accordingly, with transistor T52 turned on, a voltage is produced across resistor R59 and the signal potential at point 340 is applied on lead 350 to the audio amplifier 400. The potential at point 340 back biases diode D54 to prevent the percussive control circuit from introducing a percussive decay on non-percussive signals. The signal at pin 1 of the microcomputer 200 for non-percussive tones is as described in a table reproduced herein before.

Miscellaneous

The capacitor CC1 in the start control circuit 100 provides a discharge path for any stray or extraneous pulses that may appear on the common lead 101. The diode DC1 prevents any stray potential which may appear on the common lead 101 from feeding back into the microcomputer circuit 200. Capacitor C11 and R11 serve as a discharge path for any stray transients that may appear. The resistor RP3 serves to limit the emitter-collector current in the priority transistor TP1. Diode DM1 is provided to discharge capacitor CM1 on a power loss, and to prevent a negative charge from being applied to the microcomputer 200.

It should be observed that the entire circuit may be packaged as a unit in a housing that is scarcely larger than that required for accommodating the speaker 450. Accordingly, there is provided a small, effective, efficient, and economical self-contained unit which may be used anywhere that a power supply is available. However, it should also be understood that rather than providing a regulated power supply circuit it would also be possible to operate the system from battery power and- /or to provide a stand-by battery to operate the system in the event of a commercial power failure. Furthermore, it is also evident that the system could be redesigned using different components to function with a different voltage level.

Typical Values of Selected Elements In The System

| ohms | | | |
|---|---|---|---|
| R11 | 470 | C11 | .001 mf |
| R12 | 10K | CM1 | .1 mf |
| RM1 | 187K | C51 | .1 mf |
| R51 | 390K | C52 | .22 mf |
| R52 | 10K | C53 | 470 pf |
| R53 | 22K | C61 | .1 mf |
| R54 | 390K | C62 | 2.2 mf |
| R55 | 150K | | |
| R56 | 910K | | |
| R57 | 6.8K | | |
| R58 | 2K | | |
| R59 | 10K | | |
| R61 | 10K | | |
| R62 | 10K | | |
| R63 | 10K | | |

While there has been shown and described what is considered at present to be a preferred embodiment of the invention, modifications thereto will readily occur to those skilled in the related arts. For example, in another structure provision might have been made for a different number of audible signals or for more or less programmable inputs and/or a different number of fixed inputs. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. A multiple tone programmable speaker comprising in combinaton:

(a) a microcomputer having a plurality of input control terminals for selectively controlling the production of any one of N unique output signals on a plurality of output terminals in response to the coupling together of the leads of a predetermined one of N predetermined unique combinations of said plurality of input control terminals;

(b) a system power supply;

(c) a speaker;

(d) an audio amplifier coupled between said speaker and said output terminals of said microcomputer for amplifying said one of said N unique output signals and applying the amplified signal to said speaker;

(e) start control means including not more than N, start control terminals coupled by first coupling means to at least selected ones of said plurality of input control terminals;

(f) circuit means interconnecting said system power supply, said microcomputer, said audio amplifier and said start control means; and wherein (g) said first coupling means includes means for coupling together the leads of one of said N predetermined unique combinations of said plurality of input control terminals in response to coupling a predetermined potential to one of said start control terminals.

2. The combination as set forth in claim 1 wherein the leads of a predetermined one of said N predetermined unique combinations of input control terminals are coupled together in response to coupling said predetermined potential to a predetermined one of said start control terminals.

3. The combination as set forth in claim 2 wherein said start control means includes selectively programmable means for preselecting which one of said N predetermined unique combinations of input control terminals are coupled together in response to coupling said predetermined potential to a predetermined one of said start control terminals.

4. The combination as set forth in claim 3 wherein said start control means includes priority means responsive to the coupling of said predetermined potential to a specific one of said start control terminals.

5. The combination as set forth in claim 2 wherein said start control means includes an individual conduction control device coupled to each of said start control terminals and which is set to one state of conduction when said predetermined potential is not coupled to the associated start control terminal.

6. The combination as set forth in claim 5 wherein in response to coupling said predetermined potential to one of said start control terminals the associated conduction control device is set to another state of conduction.

7. The combination as set forth in claim 6 wherein when said associated conduction control device is set to its said another state of conduction the terminals of a predetermined one of said N unique combinations of said plurality of input control terminals are coupled together.

8. The combination as set forth in claim 7 wherein a specific one of said start control terminals has two conduction control devices coupled thereto both of which change their state of conduction in response to coupling said predetermined potential to said specific one of said start control terminals and wherein in response to the change of state of conduction of a specific one of said two conduction control devices the conduction control devices associated with at least some of said start control terminals, other than said specific one of said start control terminals, are set to their said one state of conduction irrespective of the coupling of said predetermined potential to the associated start control terminal.

9. The combination as set forth in claim 1 wherein said circuit means includes an output signal control circuit coupled between said plurality of output terminals of said microcomputer and the input to said audio amplifier for responding to the signals on said output terminals.

10. The combination as set forth in claim 9 wherein said output terminals comprise a plurality of terminals a first one of which has a first and second predetermined potential applied thereto when the audio signal is to constitute a percussive and non-percussive characteristic, respectively.

11. The combination as set forth in claim 10 wherein said first predetermined potential is applied to said one terminal at the start of each cycle of a percussive signal.

12. The combination as set forth in claim 11 wherein a second one of said output terminals is coupled to a first RC time constant circuit in said output signal control circuit.

13. The combination as set forth in claim 12 wherein said RC time constant circuit is coupled to a second conduction control device for controlling the conductivity thereof.

14. The combination as set forth in claim 13 wherein a third one of said output terminals of said microcomputer has a signal applied thereto by said microcomputer which is unique for each of said N output signals and wherein said third one of said output terminals is coupled to said second conduction control device for the passage of said signal therethrough while the magnitude thereof is under the control of said second conduction control device.

15. The combination as set forth in claim 14 wherein the discharge of said first RC time constant circuit causes said second conduction control device to reduce its conductivity logarithmical.

16. The combination as set forth in claim 15 wherein said second one of said output terminals is coupled to a second RC time constant circuit as well as to said first RC time constant circuit.

17. The combination as set forth in claim 16 wherein said first and second RC time constant circuits are both coupled to said second conduction control device.

18. The combination as set forth in claim 17 wherein the capacitors of said first and second RC time constant circuits are charged through individual respective diodes.

19. The combination as set forth in claim 18 wherein said audio percussive signals comprise first and second types which have first and second repetition rates with said second repetition rate having at least an order of magnitude more cycles per unit time than said first repetition rate.

20. The combination as set forth in claim 19 wherein said first and second RC time constant circuits control the effective conductivity of said second conduction control device for percussive signals of said first and second types, respectively.

21. The combination as set forth in claim 14 wherein said third one of said output terminals is also coupled to a third conduction control device for controlling the conductivity thereof.

22. The combination as set forth in claim 21 wherein in response to the application of said first and second predetermined potential to said first output terminal by said microcomputer said third conduction control device is rendered non-conducting and conducting, respectively.

23. The combination as set forth in claim 22 wherein the outputs of said second and third conduction control devices are both coupled to said audio amplifier.

24. The combination as set forth in claim 23 wherein the output of said second conduction control device is coupled to said audio amplifier through a diode.

* * * * *